US007470654B2

(12) United States Patent
Meli et al.

(10) Patent No.: US 7,470,654 B2
(45) Date of Patent: Dec. 30, 2008

(54) COMPOSITION COMPRISING A SURFACE DEPOSITION ENHANCING CYCLIC ANIME-BASED CATIONIC POLYMER

(75) Inventors: Fabrizio Meli, Tynemouth (GB); Andre Chieffi, Tynemouth (GB); Rebecca Louise Selway, Wallsend (GB); Stefan Frenzel, Mannheim (GB)

(73) Assignee: The Procter & Gamble Company, Cincinnati, OH (US)

( * ) Notice: Subject to any disclaimer, the term of this patent is extended or adjusted under 35 U.S.C. 154(b) by 432 days.

(21) Appl. No.: 11/220,218

(22) Filed: Sep. 6, 2005

(65) Prior Publication Data

US 2006/0052272 A1 Mar. 9, 2006

(30) Foreign Application Priority Data

Sep. 6, 2004 (EP) ..... 04255937

(51) Int. Cl.
*C11D 7/14* (2006.01)
*C11D 3/50* (2006.01)

(52) U.S. Cl. ..... 510/349; 510/101; 510/276; 510/315; 510/377; 510/441; 510/442; 510/443; 510/444; 510/470; 510/508; 510/504; 510/532

(58) Field of Classification Search ..... 510/101, 510/276, 315, 349, 377, 441, 442, 443, 444, 510/470, 508, 532, 504
See application file for complete search history.

(56) References Cited

U.S. PATENT DOCUMENTS

| | | | | |
|---|---|---|---|---|
| 3,761,418 | A | 9/1973 | Parran, Jr. | |
| 5,500,138 | A | 3/1996 | Bacon et al. | |
| 5,648,328 | A | 7/1997 | Angell et al. | |
| 5,691,303 | A | 11/1997 | Pan et al. | |
| 5,691,383 | A | 11/1997 | Thoms et al. | |
| 5,858,959 | A * | 1/1999 | Surutzidis et al. | 510/507 |
| 5,955,419 | A | 9/1999 | Barket, Jr. et al. | |
| 6,025,319 | A | 2/2000 | Surutzidis et al. | |
| 6,048,830 | A | 4/2000 | Gallon et al. | |
| 6,221,826 | B1 | 4/2001 | Surutzidis et al. | |
| 6,245,732 | B1 | 6/2001 | Gallon et al. | |
| 6,458,754 | B1 | 10/2002 | Velazquez et al. | |
| 6,491,728 | B2 | 12/2002 | Bacon et al. | |
| 6,790,814 | B1 | 9/2004 | Marin et al. | |
| 7,091,171 | B2 * | 8/2006 | Caswell et al. | 510/439 |
| 2004/0214742 | A1 * | 10/2004 | Meli et al. | 510/504 |

FOREIGN PATENT DOCUMENTS

| | | |
|---|---|---|
| EP | 1 471 137 A1 | 10/2004 |
| EP | 1 160 311 B1 | 3/2006 |
| EP | 0859 828 B2 | 6/2006 |

OTHER PUBLICATIONS

PCT International Search Report—3 pages, Dec. 2005.

* cited by examiner

*Primary Examiner*—Charles I Boyer
(74) *Attorney, Agent, or Firm*—Ronald T. Sia; David V. Upite; Kim W. Zerby

(57) ABSTRACT

The present invention relates to a detergent auxiliary composition comprising: (i) a liquid or liquefiable active component; and (ii) a water-insoluble solid support component and (iii) a water-soluble and/or water dispersible encapsulating material; and (iv) optionally one or more adjunct components, characterised in that the composition further comprises (v) a surface deposition enhancing cationic polymer or oligomer having cationic groups such that fewer than 50% are de-activated when a 1% by weight solution of the polymer or oligomer (prepared in deionised water and then adjusted to pH 7.0 with sodium carbonate or citric acid) is stored at 25° C. for ten days (ten day storage test), wherein the surface deposition enhancing cationic polymer is adsorbed onto the water-insoluble solid support component, and wherein the water-soluble and/or water dispersible encapsulating material encapsulates the liquid or liquefiable active component, the water-insoluble solid support component and the surface deposition enhancing cationic polymer.

19 Claims, No Drawings

COMPOSITION COMPRISING A SURFACE DEPOSITION ENHANCING CYCLIC ANIME-BASED CATIONIC POLYMER

TECHNICAL FIELD

The present invention relates to detergent auxiliary compositions in particulate form comprising a surface deposition enhancing cationic polymer, methods of making such detergent auxiliary compositions, laundry detergent compositions comprising such detergent auxiliary compositions and use of said surface deposition enhancing cationic polymer to enhance the deposition of a perfume onto a fabric surface.

BACKGROUND TO THE INVENTION

Surface treatment compositions, such as fabric treatment compositions including laundry detergent compositions, typically comprise systems that deposit actives onto the surface to be treated. For example, laundry detergent compositions may comprise active components that need to be deposited onto the fabric surface before they can carry out their intended action. These active components include perfumes.

However, laundry detergent compositions are typically designed to remove material, i.e. soil, from the surface of a fabric during a laundering process. Therefore, the majority of the chemistry that is formulated into a laundry detergent composition is designed and tailored to carry out this task. Thus, it is difficult to deposit any active component onto a fabric surface during a laundering process due to this chemistry. This problem is especially true for active components that are liquid or liquefiable, such as perfumes, which are particularly troublesome to deposit onto a fabric surface during a laundering process.

Attempts have been made to improve the deposition of perfume onto a fabric surface during a laundering process by using hydrophobic perfume raw materials that have high boiling points; thus not readily evaporating from the wash liquor and more readily associating with the fabric surface due to having an increased hydrophobic interaction with the fabric surface. These perfumes are known as quadrant 4 perfume raw materials and are described in more detail in U.S. Pat. Nos. 5,500,138 and 6,491,728. However, the disadvantage of using quadrant 4 perfumes in laundry detergent compositions is that the perfumer is very limited in the choice of perfume raw materials that he can use, and the odours these quadrant 4 perfumes deliver are very musky odours that are not always suitable for use in laundry detergent compositions. In addition, the deposition of quadrant 4 perfumes onto the surface of a fabric during a laundering process is still not very efficient and still needs to be improved.

Other attempts to improve the fabric surface deposition of perfumes during a laundering process include the encapsulation of perfume raw materials, for example in starch to obtain a starch-encapsulated perfume accord. These starch-encapsulated perfume accords and their applications in laundry detergent compositions are described in more detail in WO99/55819. However, even when using these starch-encapsulated perfume accords in detergent compositions, although good wet stage odour can be achieved, perfume is still lost in the wash liquor during the laundering process, presumably being due to the fact that they are readily water-soluble and/or water-dispersible in the wash liquor.

Another approach is the loading of perfume onto porous carrier materials such as zeolite. This perfume-loaded zeolite approach is described in more detail in EP701600, EP851910, EP888430, EP888431, EP931130, EP970179, EP996703, U.S. Pat. Nos. 5,691,383, 5,955,419 and WO01/40430. However, there is a risk that the perfume may leak from the zeolite onto the detergent matrix during storage and/or leak into the wash liquor (i.e. before the zeolite has been deposited onto a fabric surface) during a laundering process. In order to overcome this problem, attempts have also been made to encapsulate these perfume-loaded zeolites with starch; this is described in more detail in EP859828, EP1160311 and U.S. Pat. No. 5,955,419. In co-pending European patent application 03252549.5 particles are described for improving efficiency of perfume deposition comprising a solid support such as zeolite supporting a liquid or liquefiable active component, that has a water-soluble and/or dispersible encapsulating material and in which a cationic polymer is adsorbed onto the water-insoluble solid support. The present inventors have now found that the performance of the particles described in this co-pending application may still be improved upon. The inventors have found that under stressed conditions the performance of these particles is diminished on storage and their studies have shown that this is due to hydrolysis of the cationic groups either diminishing the efficiency of the particle and/or resulting in undesirable by-products.

There is still therefore a need to increase the efficiency of delivery of active components incorporated in detergents, i.e. to improve the deposition of perfume and/or other liquid or liquefiable active components onto a fabric surface during a laundering process.

SUMMARY OF THE INVENTION

The present invention provides a detergent auxiliary composition in particulate form, comprising: (i) a liquid or liquefiable active component; and (ii) a water-insoluble solid support component and (iii) a water-soluble and/or water dispersible encapsulating material; and (iv) optionally one or more adjunct components, characterised in that the composition further comprises (v) a surface deposition enhancing cationic polymer or oligomer having cationic groups of which fewer than 50% hydrolyse when a 1% by weight solution of the polymer in deionised water at pH 7 is stored at 25° C. for ten days (ten day storage test), and wherein the cationic polymer is adsorbed onto the solid support component, and wherein the encapsulating material encapsulates the active component, the solid support component and the cationic polymer.

DETAILED DESCRIPTION OF THE INVENTION

Detergent Auxiliary Composition in Particulate Form

The detergent auxiliary composition is suitable for incorporation into a detergent composition, such as a laundry detergent composition; i.e. to make a fully formulated detergent composition. Alternatively, the detergent auxiliary composition is suitable for use in combination with a detergent composition such as a laundry detergent composition: i.e. as an additive to an already fully formulated detergent composition. The detergent auxiliary composition is in particulate form and comprises a liquid or liquefiable active component, a water-insoluble solid support component, a water-soluble and/or water dispersible encapsulating material, a surface deposition enhancing cationic polymer or oligomer comprising cationic groups of which fewer than 50% hydrolyse when a 1% by weight solution of the polymer in deionised water at pH 7 is stored at 25° C. for ten days, and optionally one or more adjunct components. All of these are discussed in more detail below.

Since the composition is designed to deposit the active component onto the surface of the fabric or other substrate to be treated, the composition should be capable of coming into close proximity with the treated surface. One means of achieving this is to alter the zeta potential of the particle to ensure that there is little or no repulsion between the particles of the composition and the treated surface, i.e. little or no electrochemical repulsion. It is therefore desirable to keep the electrokinetic potential, also known as the zeta potential, of the composition low in order to minimize any electrochemical repulsion that may occur between the composition and the treated surface. In one aspect of the invention, the composition may even have a positive zeta potential. Zeta potential is described in more detail in the Physical Chemistry of Surfaces, $4^{th}$ Edition, 1982, written by Adamson and published by John Wiley & Sons, especially pages 198-205 of the above document.

The zeta potential of the composition is typically determined by the following method:

1. Add 10 g of composition to 200 ml of water at 25° C. and agitate for 5 minutes.
2. Centrifuge the product of step 1 for 8,000 rpm for 10 mins in a Sigma 4-10 centrifuge.
3. Separate the sediment collected during step 2 and suspend 0.02 g of the sediment in 500 ml of an aqueous solution of 1 mM KCl.
4. Fill the chamber of a Brookhaven ZetaPlus Zeta Potential Analyzer with the above suspension of step 3.
5. Insert the full chamber into the analyser and analyse the zeta potential according the manufacturer's instructions.
6. Take an average of 10 readings to determine the zeta potential of the composition.

Preferably, the composition has a zeta potential that is more neutral than −30 mV, preferably more neutral than −20 mV. It is believed that the lower (i.e. more neutral) zeta potential is achieved due to the presence of the surface deposition enhancing cationic polymer in the composition. The composition preferably comprises from 1.2 wt % to 10 wt % surface deposition enhancing cationic polymer.

The composition typically has a mean particle size of from 5 micrometers to 200 micrometers, preferably from 10 to 50 micrometers, and/or typically no more than 10 wt % of the composition has a particle size less than 5 micrometers and/or typically no more than 10 wt % of the composition has a particle size greater than 80 micrometers. These particle size requirements and distributions are especially preferred when the detergent auxiliary composition is incorporated in a laundry detergent composition, as particles having these particle size requirements and distributions do not tend to segregate in the laundry detergent composition during transport and storage, and are stable in the laundry detergent composition during storage.

The composition may be obtainable, and/or may be obtained, by an agglomeration, spray-drying, freeze-drying or extrusion process. However, there is a highly preferred order in which the components that make up the composition are contacted to each other during the process of making the composition. This preferred process is described in more detail below.

Active Component

The active component is in a liquid or liquefiable form. Preferably the active component is in liquid form. The active component typically needs to be brought into close proximity with or even deposited onto the treated surface during the treatment process (e.g. needs to be brought into contact with the surface of a fabric being laundered in a washing or rinsing step) before it can carry out its intended function. An active component is any component for which there is a need and/or requirement to deposit it onto the treated surface, for example, to enhance its performance. The active components are not limited to active components that are inactive until they are in close proximity to, or deposited onto, the treated surface. A highly preferred active component is perfume, especially when it is desired to deliver a good dry fabric odour benefit to a fabric during a laundering process.

The perfume can be formulated to provide any olfactory perception that is desired. For example, the perfume can be a light floral fragrance a fruity fragrance or a woody or earthy fragrance. The perfume typically comprises one or more perfume raw materials (PRMs), more typically the perfume comprises numerous PRMs, i.e. at least two, or at least five or even at least ten and typically even more than that, which are typically blended together to obtain a perfume that has the desired odour. The perfume may be of a simple design and comprise only a relatively small number of PRMs, or alternatively the perfume may be of a more complex design and comprise a relatively large number of PRMs. Suitable PRMs are typically selected from the group consisting of aldehydes, ketones, esters, alcohols, propionates, salicylates, ethers and combinations thereof. Preferred perfumes and PRMs are described in more detail in WO97/11151, especially from page 8, line 18 to page 11, line 25.

The perfume typically has a threshold olfactory detection level, otherwise known as an odour detection threshold (ODT) of less than or equal to 3 ppm, more preferably equal to or less than 10 ppb. Typically, the perfume comprises PRMs that have an ODT of less than or equal to 3 ppm, more preferably equal to or less than 10 ppb. Preferred is when the perfume comprises at least 70 wt %, more preferably at least 85 wt %, PRMs that have an ODT of less than or equal to 3 ppm, more preferably equal to or less than 10 ppb. A method of calculating ODT is described in WO97/11151, especially from page 12, line 10 to page 13, line 4. Typically, the perfume has a boiling point of less than 300° C. Typically, the perfume comprises at least 50 wt %, more preferably at least 75 wt %, of PRMs that have a boiling point of less than 300° C. In addition, the perfume typically has an octanol/water partition coefficient (ClogP) value greater than 1.0. A method of calculating ClogP is described in W097/11151, especially from page 11, line 27 to page 12, line 8.

The active component, or at least part thereof, is typically adsorbed and/or absorbed onto the solid support component. This is especially preferred when the solid support component is porous and the active component (or if the active component is a perfume, then the PRMs that make up the perfume), or part thereof, can pass through the pores of the porous solid support component and be held within the porous matrix of the solid support component. Active components, especially perfumes, that are adsorbed/absorbed onto the porous solid support component can be tailored in such a way to delay the release of the active component from the solid support component.

One means of tailoring a perfume to be released slowly from a porous material is to ensure that the perfume comprises one or more PRMs that have good affinity for the porous material. For example, PRMs that have a specific size, shape (i.e. a molecular cross-sectional area and molecular volume) and surface area relative to the pores of the porous material, exhibit improved affinity for the porous material and are capable of preventing other PRMs that have less affinity to the porous material from leaving the porous material during the washing and/or rinsing stage of a laundering process. This is described in more detail in WO97/11152, especially from page 7, line 26 to page 8, line 17.

Another means of tailoring a perfume to be released slowly from a porous material is to ensure that the perfume comprises PRMs that are small enough to pass through the pores of the porous material, and that are capable of reacting together, or with a small non-perfume molecule (otherwise known as a size-enlarging agent) to form a larger molecule (otherwise known as a release inhibitor) that is too large to pass through the pores of the porous material. The release inhibitor, being too large to pass through the pores of the porous material, becomes entrapped within the porous matrix of the porous material until it breaks down (i.e. hydrolyses) and reverts back to the smaller PRM and size enlarging agent, which are then capable of passing through the pores of, and exiting, the porous material. Typically, this is achieved by the formation of hydrolysable bonds between a small PRM and a size-enlarging agent, to form a release inhibitor within the porous material. Upon hydrolysis, the small PRM is released from the larger molecule and is then capable of exiting the porous material. This is described in more detail in WO97/34981, especially from page 7, line 4 to page 5, line 14.

In addition, the above approach of forming a release inhibitor by reacting a PRM with a size-enlarging agent can be further adapted by using a size enlarging agent that has a hydrophilic portion and a hydrophobic portion (e.g. a sugar based non-ionic surfactant such as a lactic acid ester of a $C_{18}$ monoglyceride). This is described in more detail in WO97/34982, especially from page 6, line 27 to page 7, line 17.

Solid Support Component

The solid support component is insoluble in water. The solid support component interacts with the active component to provide a support for and to protect the active component during a treatment process such as a laundering process. The solid support component also enhances the deposition of the active component onto a treated surface, e.g. a fabric surface, typically by being deposited onto the treated surface itself and carrying the active component onto the treated surface with it.

The solid support component can be any water-insoluble material that is capable of supporting (e.g. by absorption or adsorption) the active component, whilst, of course, still being able to release the active component at some stage during and/or after the treatment process. Preferred solid support components are porous materials, such that the active component can pass through the pores of the porous solid support component and be held within the porous matrix of the solid support component.

Preferred solid support components are selected from the group consisting of aluminosilicates, amorphous silicates, calcium carbonates and double salts thereof, clays, chitin micro beads, crystalline non-layered silicates, cyclodextrins and combinations thereof. More preferably, the solid support component is an aluminosilicate, most preferably a zeolite, especially a faujustite zeolite, such as zeolite X, zeolite Y and combinations thereof. An especially preferred solid support component is zeolite 13x. Preferred aluminosilicates are described in more detail in WO97/11151, especially from page 13, line 26 to page 15, line 2.

It may be preferred for the solid support component to have a crystalline structure and to have an average primary crystal size in the range of from 2 to 80 micrometers, preferably from 2 to 10 micrometers and/or typically no more than 10 wt % of the primary crystals have a particle size less than 0.8 micrometers and/or typically no more than 10 wt % of the primary crystals have a particle size greater than 20 micrometers. Solid support components having these primary crystal size requirements show good deposition onto the treated surface, show good release dynamics of the active component, show improved active component loading capability and do not give rise to any cleaning and/or treatment negatives.

Although the solid support material is typically charge neutral, preferably, the outer surface of the solid support component has a negatively charged surface (the solid support has a negative zeta potential or electrophoretic mobility), especially in aqueous solution at neutral pH (i.e. pH 7). Typically, the solid support component comprises an oxide outer surface; i.e. the outer surface of the solid support component comprises oxide moieties. A solid support component having a negatively charged outer surface charge, more readily interacts with the surface deposition enhancing cationic polymer, due to increased electrochemical attraction between the cationic polymer and negatively charged outer surface of the solid support component. This is especially preferred when the surface deposition enhancing cationic polymer has a specific charge density and/or a specific degree of cationic substitution, as then there is an optimal affinity between the cationic polymer and the solid support component, which results in improved deposition of the active component onto the treated surface, especially a fabric surface during a laundering process.

Encapsulating Material

The encapsulating material is water-soluble. The encapsulating material typically encapsulates at least part, preferably all, of the active component, solid support component and cationic polymer. In this manner, the encapsulating material protects the components it encapsulates from the external environment during storage and also during the early and possibly even late stages of the treatment process. The encapsulating material typically dissolves at some point during the washing stage of the treatment process, and releases the solid support component along with the active component and surface deposition enhancing cationic polymer, into the wash liquor. The solid support component is then able to deposit onto the treated surface and bring the active component into close proximity to the treated surface.

The encapsulating material can be used as a delay release means for the active component in the treatment process. For example, the water-solubility of the encapsulating material can be increased or decreased to enable the release of the active component into the wash liquor at an early or late stage in the treatment process. For example, if the active component is a perfume and it is desired to deliver a good dry fabric odour benefit to a fabric during a laundering process, then it may be preferred to delay the release of the perfume into the wash liquor until a late stage in the laundering process so as to prevent, or greatly reduce, the loss of perfume which may otherwise occur.

The encapsulating material may have a glass transition temperature (Tg) of 0° C. or higher. Glass transition temperature is described in more detail in WO97/11151, especially from page 6, line 25 to page 7, line 2. By controlling the glass transition temperature of the encapsulating material, the frangibility of the composition can be controlled to avoid the break up of the composition, which is in particulate form, during handling, transport and storage, this will also reduce the generation of dust which may occur during handling and transport. One way to control the glass transition temperature of the encapsulating material is to incorporate a plasticiser, typically, a plasticiser other than water, in the encapsulating material. Any known plasticisers, other than water, can be used. If the encapsulating material is a starch, then preferred plasticisers are selected from the group consisting of mono- and di-saccharides, glycerine, polyols and mixtures thereof The encapsulating material is preferably selected from the group consisting of carbohydrates, natural and/or synthetic gums, cellulose and/or cellulose derivatives, polyvinyl alcohol, polyethylene glycol, and combinations thereof. Preferably the encapsulating material is a carbohydrate, typically selected from the group consisting of monosaccharides, oligosaccharides, polysaccharides, and combinations thereof. Most preferably, the encapsulating material is a starch. Preferred starches are described in EP922499, U.S. Pat. Nos. 4,977,252, 5,354,559 and 5,935,826.

Surface Deposition Enhancing Cationic Polymer

As used herein, the expression polymer includes copolymers. The surface deposition enhancing cationic polymer or oligomer enhances the deposition of the active component, which is usually held within or by the solid support component, onto the surface to be treated. Without wishing to be bound by theory, it is believed that the cationic polymer, once adsorbed onto the solid support component, diminishes, preferably negates, any repulsion, i.e. electrostatic repulsion, that may occur between the outer surface of the solid support component and the treated surface; this is believed to be especially true when the outer surface of the solid support component is negatively charged and the treated surface is a fabric surface. The surface deposition enhancing cationic polymer or oligomer typically reduces the zeta potential of the composition.

The cationic polymer or oligomer should therefore have cationic groups of which fewer than 50% are de-activated when a 1% by weight solution of the polymer or oligomer (prepared in deionised water and then adjusted to pH 7.0 with sodium carbonate or citric acid) is stored at 25° C. for ten days (ten day storage test). By de-activation is meant loss of cationicity. Whilst de-activation is usually by hydrolysis any other mechanism that results in loss of one or more cationic groups under these conditions is intended to be included in this definition. Preferably under such conditions fewer than 30%, preferably fewer than 20% or even fewer than 10% or 5% of the cationic groups are de-activated in the ten day storage test defined above.

Preferably, therefore, the cationic groups are selected so that they are not highly susceptible to hydrolysis under these conditions. The amount of de-activation may be detected in any suitable way depending on the chemistry of the cationic groups. The skilled person will be familiar with suitable methods for determining de-activation of the cationic groups e.g. by detecting the by-products resulting from a hydrolysis reaction or by analysis of the polymer itself. Physical or chemical means may be used, for example NMR, mass spectroscopy, viscosity analysis or titration methods. Preferred cationic polymers or oligomers have at least 4 cationic groups, preferably at least 7 or even at least 8 or 10 or 12 cationic groups. Without wishing to be bound by theory, it is believed that this is because although the separate cationic groups are reversibly attracted to the negative charge on the surface of the water-insoluble support component, in view of the slow dynamics of polymer systems in order for the polymer to desorb from the surface of the water-insoluble solid support, all of the cationic groups must detach at approximately the same time. With the preferred minimum number of cationic groups identified, we have found that the desired performance is achieved. Most preferably, the cationic polymers have this number of cationic groups even after deactivation of any cationic groups using the ten day storage test at pH 7.0 as discussed above.

Particularly preferred cationic polymers or oligomers comprise cationic groups provided by cyclic amine groups, preferably unsaturated cyclic amine groups. A preferred class of oligomers and polymers are those described in WO99/14300 which relates to polymers which have the following general formula:

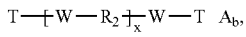

wherein;

each T is independently selected from the group consisting of H, $C_1$-$C_{12}$ alkyl, substituted alkyl, $C_7$-$C_{12}$ alkylaryl,

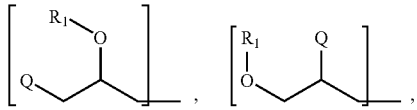

and —$R_2$Q;

wherein W comprises at least one cyclic constituent selected from the group consisting of:

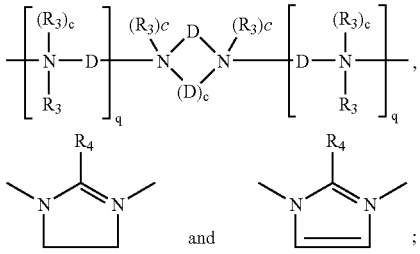

in addition to the at least one cyclic constituent, W may also comprise an aliphatic or substituted aliphatic moiety of the general structure;

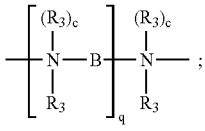

each B is independently $C_1$-$C_{12}$ alkylene, $C_1$-$C_{12}$ substituted alkylene, $C_3$-$C_{12}$ alkenylene, $C_8$-$C_{12}$ dialkylarylene, $C_8$-$C_{12}$ dialkylarylenediyl, and —$(R_5O)_nR_5$—;

each D is independently $C_2$-$C_6$ alkylene;

each Q is independently selected from the group consisting of hydroxy, $C_1$-$C_{18}$ alkoxy, $C_2$-$C_{18}$ hydroxyalkoxy, amino, $C_1$-$C_{18}$ alkylamino, dialkylamino, trialkylamino groups, heterocyclic monoamino groups and diamino groups;

each $R_1$ is independently selected from the group consisting of H, $C_1$-$C_8$ alkyl and $C_1$-$C_8$ hydroxyalkyl;

each $R_2$ is independently selected from the group consisting of $C_1$-$C_{12}$ alkylene, $C_1$-$C_{12}$ alkenylene, —$CH_2$—CH($OR_1$)—$CH_2$, $C_8$-$C_{12}$ alkarylene, $C_4$-$C_{12}$ dihydroxyalkylene, poly($C_2$-$C_4$ alkyleneoxy)alkylene, $H_2CH$ $(OH)CH_2OR_2OCH_2CH(OH)CH_2$—, and $C_3$-$C_{12}$ hydrocarbyl moieties; provided that when $R_2$ is a $C_3$-$C_{12}$ hydrocarbyl moiety the hydrocarbyl moiety can comprise from about 2 to about 4 branching moieties of the general structure:

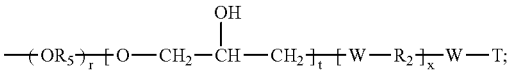

each $R_3$ is independently selected from the group consisting of H, $R_2$, $C_1$-$C_{20}$ hydroxyalkyl, $C_1$-$C_{20}$ alkyl, substituted alkyl, $C_6$-$C_{11}$ aryl, substituted aryl, $C_7$-$C_{11}$ alkylaryl, and $C_1$-$C_{20}$ aminoalkyl;

each $R_4$ is independently selected from the group consisting of H, $C_1$-$C_{22}$ alkyl, $C_1$-$C_{22}$ hydroxyalkyl, aryl and $C_7$-$C_{22}$ alkylaryl;

each $R_5$ is independently selected from the group consisting of $C_2$-$C_8$ alkylene, $C_2$-$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from 0 to about 6;

each n is independently from 1 to about 20;

each r is independently from 0 to about 20; and each t is independently from 0 to 1; and in the polymer or oligomer there must be at least 4, preferably at least 7 or at least 10 or even at least 12 quaternary N groups.

In particular preferred polymers, chemical stabilisation may be used to stabilise the quaternary N groups against de-activation in the ten day storage test at pH 7.0 as defined above. Thus in preferred polymers or oligomers for use in the present invention, at least one, W group comprises:

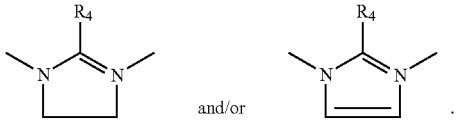

Preferably W and x are selected such that there are at least 4 or at least 7 or even at least 10 or 12 of these groups. A particularly highly preferred cationic group is provided by:

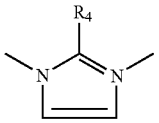

Also, in preferred oligomers or polymers of the formula given above, each $R_1$ is H.

Preferred compounds to be used as the linking group $R_2$ include, but are not limited to: polyepoxides, ethylenecarbonate, propylenecarbonate, urea, α,β-unsaturated carboxylic acids, esters of α,β-unsaturated carboxylic acids, amides of α,β-unsaturated carboxylic acids, anhydrides of α,β-unsaturated carboxylic acids, di- or polycarboxylic acids, esters of di- or polycarboxylic acids, amides of di- or polycarboxylic acids, anhydrides of di- or polycarboxylic acids, glycidylhalogens, chloroformic esters, chloroacetic esters, derivatives of chloroformic esters, derivatives of chloroacetic esters, epihalohydrins, glycerol dichlorohydrins, bis-(halohydrins), polyetherdihalo-compounds, phosgene, polyhalogens, functionalized glycidyl ethers and mixtures thereof. Moreover, $R_2$ can also comprise a reaction product formed by reacting one or more of polyetherdiamines, alkylenediamines, polyalkylenepolyamines, alcohols, alkyleneglycols and polyalkyleneglycols with α,β-unsaturated carboxylic acids, esters of α,β-unsaturated carboxylic acids, amides of α,β-unsaturated carboxylic acids and anhydrides of α,β-unsaturated carboxylic acids provided that the reaction products contain at least two double bonds, two carboxylic groups, two amide groups or two ester groups.

Additionally preferred cyclic amine based polymer or oligomer materials for use herein include adducts of two or more compositions selected from the group consisting of piperazine, piperadine, epichlorohydrin, epichlorohydrin benzyl quat, epichlorohydrin methyl quat, morpholine and mixtures thereof.

These cyclic amine based polymers can be linear or branched. One specific type of branching can be introduced using a polyfunctional crosslinking agent. An example of such a polymer is exemplified below.

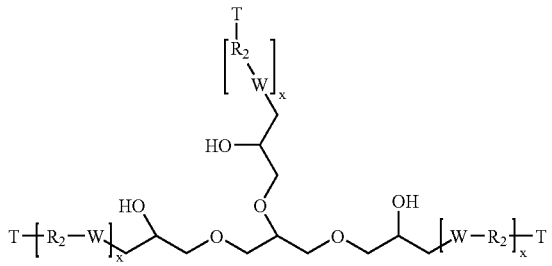

Particularly preferred cationic polymers are:

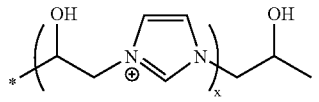

* represents T

The surface deposition enhancing cationic polymers defined, having the preferred average degree of cationic substitution and/or at least 4 or more preferably at least 7 or at least 10 or at least 12 quaternary ammonium groups more readily interact with the solid support component and further enhance the deposition of the active component onto the treated surface during the treatment process. This is especially true for laundering processes and also when the active component is a perfume. The cationic polymer preferably has an average degree of cationic substitution of from 1% to 70%, preferably from above 20% to 70%, more preferably from 40% to 60%. It will be understood by the skilled person that for low molecular weights the percentage of cationic substitution will need to be in the upper end of this range as the cationic polymer should also typically have at least 4 cationic groups, preferably quaternary ammonium groups.

The average degree of cationic substitution typically means the molar percentage of monomers in the cationic polymer that are cationically substituted. The average degree of cationic substitution can be determined by any known method, such as colloid titration. One such colloid titration method is described in more detail by Horn, D., in Prog. Colloid & Polymer Sci., 1978, 8, p 243-265.

As will be apparent to those skilled in the art, an oligomer is a molecule consisting of only a few monomer units while polymers comprise more monomer units. For the present invention, oligomers are defined as molecules having a weight average molecular weight up to about 1,000 Daltons and polymers are molecules having a weight average molecular weight of greater than about 1,000 Daltons. Copolymers are polymers or oligomers wherein two or more dissimilar monomers have been simultaneously or sequentially polymerized. Copolymers of the present invention can include, for example, polymers or oligomers polymerized from a mixture of a primary cyclic amine based monomer, e.g., piperadine, and a secondary cyclic amine monomer, e.g., morpholine.

The weight average molecular weight of the cationic oligomers or polymers for use in the invention is generally from 500 to 1 000 000 Daltons, preferably from 750 to 50 000 Daltons or even 1000 to 20 000 or 10 000.

Any known gel permeation chromatography (GPC) measurement methods for determining the weight average molecular weight of a polymer can be used to measure the weight average molecular weight of the cationic polymer. GPC measurements are described in more detail in Polymer Analysis by Stuart, B. H., p 108-112, published by John Wiley & Sons Ltd, UK, © 2002.

A typical GPC method for determining the weight average molecular weight of a polymer is described below:

1. Dissolve 1.5 g of polymer in 1 litre of deionised water.
2. Filter the mixture obtained in step 1., using a Sartorius Minisart RC25 filter.
3. According the manufacturer's instructions, inject 100 litres of the mixture obtained in step 2., on a GPC machine that is fitted with a Suprema MAX (8 mm by 30 cm) column operating at 35° C. and a ERC7510 detector, with 0.2M aqueous solution of acetic acid and potassium chloride solution being used as an elution solvent at a flux of 0.8 ml/min.
4. The weight average molecular weight is obtained by analysing the data from the GPC according to the manufacturer's instructions.

Cationic polymers having this preferred weight average molecular weight and preferred average degree of cationic substitution can be used to enhance the deposition of a perfume onto a fabric surface.

The cationic polymer is typically water-soluble and/or water-dispersible, preferably water-soluble. Water-soluble and/or water dispersible cationic polymers, especially water-soluble cationic polymers show a surprising good ability to deposit the active component onto the treated surface.

Laundry Detergent Compositions Comprising the Detergent Auxiliary Composition

The detergent auxiliary composition is preferably incorporated in a laundry detergent composition. The laundry detergent composition is used to launder fabrics and provides a good dry fabric odour benefit to the fabric due to the presence of the detergent auxiliary composition in the laundry detergent composition. The laundry detergent composition typically comprises one or more adjunct components. These adjunct components are described in more detail below. The laundry detergent composition may be the product of a spray-dry and/or agglomeration process.

Optional Adjunct Components

The detergent auxiliary composition and/or the laundry detergent composition may optionally comprise one or more adjunct components. These adjunct components are typically selected from the group consisting of detersive surfactants, builders, polymeric co-builders, bleach, chelants, enzymes, anti-redeposition polymers, soil-release polymers, polymeric soil-dispersing and/or soil-suspending agents, dye-transfer inhibitors, fabric-integrity agents, brighteners, suds suppressors, fabric-softeners, flocculants, and combinations thereof. Suitable adjunct components are described in more detail in WO97/11151, especially from page 15, line 31 to page 50, line 4.

Method of Making the a Detergent Auxiliary Composition

The detergent auxiliary composition is typically obtained by a method comprising the steps of: (i) contacting a water-insoluble solid support component with a liquid or liquefiable active component to form a first mixture; and (ii) contacting the first mixture obtained in step (i) with a surface deposition enhancing cationic polymer comprising cationic groups of which fewer than 50% are de-activated when a 1% by weight solution of the polymer (prepared in deionised water and then adjusted to pH 7.0 with sodium carbonate or citric acid) is stored at 25° C. for ten days (ten day storage test); and (iii) contacting the second mixture obtained in step (ii) with a water-soluble and/or water-dispersible encapsulating material to form a composition; and (iv) optionally, drying the composition, wherein step (iii) occurs subsequent to steps (i) and (ii) and prior to steps (iii) and (iv).

Although the first contact step, step (i) may be carried out by any means for mixing the two components together, for efficiency, the first step of contacting a solid support component with an active component to form a first mixture is typically carried out in a high shear mixer such as a Schuggi mixer or other high shear mixer, for example a CB mixer, although other lower shear mixers, such as a KM mixer, may also be used. Typically, the solid support component is passed through the mixer and the active component is sprayed onto the solid support component. If the active component adsorbs or absorbs onto the solid support component (for example, if the active component is a perfume and the solid support component is a zeolite), then this reaction is typically exothermic and heat is generated during this stage of the process. This of course depends on the active component used and the solid support component used. Furthermore, the build up of heat during this step is more likely to occur when the process is a continuous process (as opposed to a batch process). The generation of heat can be controlled by any suitable heat management means; such as placing water jackets or coils on the mixer or other vessel used in step (i), or by direct cooling, for example by using liquid nitrogen, to remove the heat that is generated, and/or by controlling the flow rate of the active component and/or the solid support component in the mixer or other vessel used in step (i).

Step (ii) of contacting the first mixture obtained in step (i) with the surface deposition enhancing cationic polymer to form a second mixture can occur in any suitable vessel such as a stirred tank. Alternatively, step (ii) can occur in an online mixer. The stirred tank can be a batch tank or a continuous tank. Typically this step is carried out in an aqueous environment. Typically, the cationic polymer is diluted in water to form an aqueous mixture. The concentration of the cationic polymer in the aqueous mixture is from 0.3 g/l to 50 g/l, preferably from 10 g/l to 30 g/l. Cationic polymers being present at these preferred concentrations show optimal adsorption onto the solid support component.

In addition to this, it is also desirable to control the concentration of the solid support component in the aqueous mixture. Preferably, the concentration of the solid support component in the aqueous mixture is from 7 g/l to 2,000 g/l, preferably from 500 g/l to 1,000 g/l. Solid components being present at these preferred concentrations enable an efficient particle production process and efficient uptake of the cationic polymer.

It may also be desirable to control the electrochemistry of the cationic polymer and the solid support component during step (ii) to ensure that they have optimal affinity to each other during this step. One means of controlling the electrochemistry is to control the pH of step (ii). This also has the benefit or reducing any deactivation by hydrolysis. Preferably step (ii) is carried out in an aqueous environment having a pH of from 3 to 9, most preferably from 4 to 7. In order to achieve the desired pH, acid or base may be added at some stage prior to or simultaneously with contact of the mixture formed in step (i) with the cationic polymer in step (ii). The acid or base may be added during formation of the mixture of step (i) or may be added simultaneously or sequentially with the cationic polymer whilst forming the mixture of step (ii). Generally acid is most likely to be required to adjust the pH as needed. Preferably step (iii) is also carried out at pH 3 to 9, most preferably 4 to 7.

Any acid is suitable for lowering pH to produce a mixture of the desired pH, such as conventional mineral acids (hydrochloric acid, nitric acid, sulphuric acids), but preferably organic acids such as polycarboxylic acids are used. These may be polymeric but are preferably monomeric such as citric acid, succinic acid, maleic acid, malic acid, itaconic acid, tartaric acid, aspartic acid. Sulpahmic acid is a further useful alternative. Citric acid is particularly preferred.

The time of step (ii) should typically be sufficient to allow adsorption of the cationic polymer onto the solid support material. Preferably the time of step (ii) is from 5 minutes to 25 minutes, most preferably from 10 minutes to 15 minutes.

Step (iii), of contacting the second mixture obtained in step (ii) with a water-soluble and/or water-dispersible encapsulating material to form a composition, can occur in any suitable vessel such as a stirred tank. Alternatively, step (iii) can occur in an online mixer. The stirred tank can be a batch tank or a continuous tank. It may be preferred to control the temperature of step (iii) especially in order to obtain a composition comprising a high level of active component.

Preferably, step (ii) and/or (iii) is carried out a temperature of less than 50° C., or even less than 20° C. It may be preferred that cooling means such as a water jacket or even liquid nitrogen are used in step (ii) and/or (iii), this is especially typical when it is desirable to carry out step (ii) and/or (iii) at a temperature that is below the ambient temperature. It may also be preferred to limit the energy condition of step (ii) and/or (iii) in order to obtain a composition comprising a high level of active component.

Step (ii) and/or (iii) is preferably done in a low shear mixer, for example a stirred tank. This is especially preferred if the active component is a perfume.

Optional step (iv), of drying the composition of step (iii), can be carried out in any suitable drying equipment such a spray-dryer and/or fluid bed dryer. Typically, the composition of step (iii) is forced dried (for example, spray-dried or fluid bed dried) and is not left to dry by evaporation at ambient conditions. Typically, heat is applied during this drying step. Typically, the product of step (iii) is spray-dried. If the active component is volatile, e.g. a perfume, then preferably, the temperature of the drying step is carefully controlled to prevent the active component from vapourising and escaping from the composition obtained in step (iii). Preferably, the composition of step (iii) is spray-dried in a spray-drying tower, and preferably the difference between the inlet air temperature and the outlet air temperature in the spray-drying tower is less than 150° C., or even less than 120° C. or less than 100° C. This is a smaller temperature difference than is conventionally used, for example in spray-drying laundry detergent components, but is preferred in order to prevent the unwanted vapourisation of any volatile active component from the composition that was obtained in step (iii). Typically, the inlet air temperature of the spray-drying tower is from 170° C. to 220° C., and the outlet air temperature of the spray-drying tower is from 90° C. to 110° C. Highly preferred is when the inlet air temperature of the spray-drying tower is from 170° C. to 180° C., and the outlet air temperature of the spray-drying tower is from 100° C. to 105° C. It is also important that a good degree of atomisation of the composition obtained in step (iii) is achieved during the spray-drying process, as this ensures that the resultant detergent auxiliary composition has the optimal particle size distribution, having good flowability, solubility, stability and performance. The degree of atomisation can be controlled by carefully controlling the tip speed of the rotary atomiser in the spray-drying tower. Preferably, the rotary atomiser has a tip speed of from 100 $ms^{-1}$ to 500 $ms^{-1}$.

It may be preferred that during its processing and storage thereafter, the composition and any intermediate composition/product that is formed during its processing, is kept in an environment having a low relative humidity. Preferably the air in contact with the composition (or intermediate composition/product thereof) is equal to or lower than, preferably lower than, the equilibrium relative humidity of the composition (or intermediate composition/product thereof). This can be achieved, for example, by placing the composition in air tight containers during storage and/or transport, or by the input of dry and/or conditioned air into the mixing vessels, storage and/or transport containers during the process, transport and/or storage of the composition (or intermediate composition/product thereof).

EXAMPLES

Example 1

Synthesis of an Adduct (Copolymer) of Imidazole and Epichlorohydrin (Ratio of Imidazole:Epichlorohydrin 1:1)

The polycationic condensate is prepared by reacting imidazole and epichlorohydrin. To a round bottomed flask equipped with a magnatic stirrer, condenser and a thermometer are added imidazole (0.68 moles) and 95 mL water. The solution is heated to 50° C. followed by dropwise addition of epichlorohydrin (0.68 moles). After all the epichlorohydrin is added, the temperature is raised to 80° C. until all the alkylating agent is consumed. The condensate produced had molecular weight of about 12,500.

Example 2

Synthesis of the Adduct of Imidazole and Epichlorohydin (Ratio of Imidazole:Epichlorohydrin 1.4:1)

To a round bottomed flask equipped with a magnetic stirrer, condenser and a thermometer are added imidazole (0.68 moles) and 95 mL water. The solution is heated to 50° C. followed by dropwise addition of epichlorohydrin (0.50 moles). After all the epichlorohydrin is added, the temperature is raised to 80° C. until all the alkylating agent is consumed. The condensate produced had molecular weight of about 2000.

Example 3

The following perfume accords A, B and C are suitable for use in the present invention. Amounts given below are by weight of the perfume accord.

Example 3

Perfume Accord A

| PRM trade name | PRM chemical name | Amount |
|---|---|---|
| Damascone beta ™ | 2-buten-1-one, 1-(2,6,6-trimethyl-1-cyclohexen-1-yl)- | 1% |
| Dynascone 10 ™ | 4-Penten-1-one, 1-(5,5-dimethyl-1-cyclohexen-1-yl)- | 5% |
| | Ethyl 2 Methyl Butyrate | 6% |

-continued

| PRM trade name | PRM chemical name | Amount |
|---|---|---|
| Eugenol | 4-hydroxy-3-methoxy-1-allylbenzene | 1% |
| Cyclacet ™ | Tricyclo decenyl acetate | 3% |
| Cyclaprop ™ | Tricyclo decenyl propionate | 6% |
| Ionone beta ™ | 2-(2,6,6-Trimethyl-1-cyclohexen-1-yl)-3-buten-2-one | 8% |
| Nectaryl ™ | 2-(2-(4-Methyl-3-cyclohexen-1-yl)propyl)cyclopentanone | 50% |
| Triplal ™ | 3-cyclohexene-1-carboxaldehyde, dimethyl | 10% |
| Verdox ™ | Ortho tertiary butyl cyclohexanyl acetate | 10% |

Perfume accord A is an example of a fruity perfume accord.

Example 3

Perfume Accord B

| PRM trade name | PRM chemical name | Amount |
|---|---|---|
| Ally amyl glycolate ™ | Glycolic acid, 2-pentyloxy:allyl ester | 5% |
| Damascone beta ™ | 2-buten-1-one, 1-(2,6,6-trimethyl-1-cyclohexen-1-yl)- | 2% |
| Dynascone 10 ™ | 4-Penten-1-one, 1-(5,5-dimethyl-1-cyclohexen-1-yl)- | 5% |
| Hedione ™ | Cyclopentaneacetic acid, 3-oxo-2-pentyl-methyl ester | 25% |
| Iso cyclo citral | 3-cyclohexene-1-carboxaldehyde, 2,4,6-trimethyl | 5% |
| Lilial ™ | 2-Methyl-3-(4-tert-butylphenyl)propanal | 48% |
| Rose oxide | Methyl iso butenyl tetrahydro pyran | 5% |
| Triplal ™ | 3-cyclohexene-1-carboxaldehyde, dimethyl | 5% |

Perfume accord B is an example of a floral green perfume accord.

Example 3

Perfume Accord C

| PRM trade name | PRM chemical name | Amount |
|---|---|---|
| Hedione ™ | Cyclopentaneacetic acid, 3-oxo-2-pentyl-methyl ester | 30% |
| Isoraldeine 70 ™ | Gamma-methylionone | 30% |
| Dodecanal | Lauric Aldehyde | 1% |
| Lilial ™ | 2-Methyl-3-(4-tert-butylphenyl)propanal | 30% |
| | Methyl Nonyl Acetaldehyde | 1% |
| Triplal ™ | 3-cyclohexene-1-carboxaldehyde,dimethyl | 5% |
| | Undecylenic Aldehyde | 3% |

Perfume accord C is an example of a floral aldehydic perfume accord.

Example 4

Process for Preparing an Encapsulated Perfume Particle

The perfume accords of example 3 undergo the following process to obtain perfume particles that are suitable for use in the present invention.

Zeolite 13X is passed through a jacketed KM-130 mixer, wherein the perfume accord (any one of the perfume accords of example 3) is sprayed onto the zeolite 13x to obtain perfume-loaded zeolite 13x comprising 84% zeolite 13x and 16% perfume accord. The KM-130 mixer is operated at 156 rpm. Ambient water is passed through the cooling jacket to control the build up of heat that occurs during this perfume-loading step, which is carried out at a temperature of below 40° C.

A 45 wt % solution of (any one of the polymers of example 1 or example 2) is diluted in water to obtain a 1.6% wt % solution. The perfumed zeolite described above is added to this solution resulting in a suspension (35 wt % perfumed zeolite, 1 wt % polymer 64 wt % water). The suspension is stirred for 15 minutes. External cooling (water jacket) is provided, to keep the suspension temperature below 20° C.

Citric acid and a suspension of starch (33 w/v % in water) is added to the suspension described above to form an encapsulation mixture comprising 12 wt % starch, 27% wt % perfume-loaded zeolite 13x, 0.6 wt % cationic polymer, 0.4% citric acid, and 60% water. This is carried out in a batch container. The time of this step is 2 minutes and the temperature is kept below 20° C. by using a water jacket.

The encapsulation mixture is fed continuously to a buffer tank, from where it is spray dried. The encapsulation mixture is pumped into a Production Minor using a peristaltic pump and then spray dried to obtain perfume particles. The rotary atomiser tip speed was 151.8 m/s (29000 rpm of a 10 cm diameter atomiser). The inlet temperature of the spray-drying tower is 170° C. and the outlet temperature of the spray-drying tower is 105° C.

Example 5

Laundry Detergent Compositions

The perfume particles of example 4 are incorporated into the following solid laundry detergent composition, which are suitable for use in the present invention. Amounts given below are by weight of the composition.

| Ingredient | A | B | C | D | E |
|---|---|---|---|---|---|
| Perfume particle according to example 4 | 3% | 2% | 1% | 3% | 2% |
| Sodium linear $_{C11-13}$ alkylbenzene sulphonate | 15% | 18% | 15% | 11% | 10% |
| $R_2N^+(CH_3)_2(C_2H_4OH)$, wherein $R_2 = C_{12}$-$C_{14}$ alkyl group | 0.6% | | 0.5% | 0.6% | |
| Sodium $C_{12-18}$ linear alkyl sulphate condensed with an average of 3 to 5 moles of ethylene oxide per mole of alkyl sulphate | | 2.0% | 0.8% | | |
| Mid chain methyl branched sodium $C_{12-18}$ linear alkyl sulphate | | | | 1.4% | |

-continued

| Ingredient | A | B | C | D | E |
|---|---|---|---|---|---|
| Sodium linear $C_{12-18}$ linear alkyl sulphate | | | | 0.7% | |
| Sodium tripolyphoshate (anhydrous weight given) | 25% | 22% | 30% | | |
| Citric acid | | | | 2.5% | 2.0% |
| Sodium carboxymethyl cellulose | 0.3% | 0.2% | | 0.2% | 0.2% |
| Hydrophobically modified (e.g. ester modified) cellulose | | | | 0.8% | 0.7% |
| Sodium polyacrylate polymer having a weight average molecular weight of from 3,000 to 5,000 | | 0.5% | 0.8% | | |
| Copolymer of maleic/acrylic acid, having a weight average molecular weight of from 50,000 to 90,000, wherein the ratio of maleic to acrylic acid is from 1:3 to 1:4 | | | | 1.4% | 1.5% |
| Sulphated or sulphonated bis(($C_2H_5O$)($C_2H_4O$)$_n$)($CH_3$)$N^+C_xH_{2x}N^+$($CH_3$)bis($C_2H_5O$)($C_2H_4O$)$_n$), wherein n = from 20 to 30 and x = from 3 to 8 | | 1.5% | 1.0% | | 1.0% |
| Diethylene triamine pentaacetic acid | 0.2% | 0.3% | 0.3% | | |
| Diethylene triamine pentaacetic acid | | | | 0.2% | 0.3% |
| Proteolytic enzyme having an enzyme activity of from 15 mg/g to 70 mg/g | 0.5% | 0.4% | 0.5% | 0.1% | 0.15% |
| Amylolytic enzyme having an enzyme activity of from 25 mg/g to 50 mg/g | 0.2% | 0.3% | 0.3% | 0.2% | 0.1% |
| Anhydrous sodium perborate monohydrate | 5% | 4% | 5% | | |
| Sodium percarbonate | | | | 6% | 8% |
| Magnesium sulphate | | | | 0.4% | 0.3% |
| Nonanoyl oxybenzene sulphonate | 2% | 1.5% | 1.7% | | |
| Tetraacetylethylenediamine | 0.6% | 0.8% | 0.5% | 1.2% | 1.5% |
| Brightener | 0.1% | 0.1% | 0.1% | 0.04% | 0.03% |
| Sodium carbonate | 25% | 22% | 20% | 28% | 20% |
| Sodium sulphate | 14% | 14% | 7% | 12% | 15% |
| Zeolite A | 1% | 1.5% | 2% | 20% | 18% |
| Sodium silicate (2.0 R) | 0.8% | 1% | 1% | | |
| Crystalline layered silicate | | | | 3% | 3.5% |
| Photobleach | 0.005% | 0.004% | 0.005% | 0.001% | 0.002% |
| Montmorillonite clay | | | 4% | | 6% |
| Polyethyleneoxide having a weight average molecular weight of from 100,000 to 1,000,000 | | | 1% | | 2% |
| Perfume spray-on | | 0.5% | 0.3% | | 0.3% |
| Starch encapsulated perfume accord | | | 0.2% | | 0.2% |
| Silicone based suds suppressor | | | | 0.05% | 0.06% |
| Miscellaneous and moisture | to 100% | to 100% | to 100% | to 100% | to 100% |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A detergent auxiliary particle comprising:

(i) a liquid or liquefiable active component;

(ii) a water-insoluble solid support component;

(iii) a water-soluble and/or water-dispersible encapsulating material; and (iv) optionally one or more adjunct components, wherein the particle further comprises (v) a surface deposition enhancing cationic polymer or oligomer having cationic groups provided by cyclic amine groups, such that fewer than 50% of the cationic groups are de-activated when a 1% by weight solution of the polymer or oligomer (prepared in deionised water and then adjusted to pH 7.0 with sodium carbonate or citric acid) is stored at 25° C. for ten days (ten day storage test), wherein at least part of, the surface deposition enhancing cationic polymer or oligomer is adsorbed onto the water-insoluble solid support component, and wherein the water-soluble and/or water dispersible encapsulating material encapsulates at least part of, the liquid or liquefiable active component, the water-insoluble solid support component and the surface deposition enhancing cationic polymer.

2. A detergent auxiliary particle according to claim 1, wherein all of the surface deposition enhancing polymer or oligomer is adsorbed onto the water-insoluble solid support component.

3. A detergent auxiliary particle according to claim 1, wherein the water-soluble and/or water dispersible encapsulating material encapsulates all of the liquid or liquefiable active component, the water-insoluble solid support component and the surface deposition enhancing cationic polymer.

4. A particle according to claim 1, wherein the water-insoluble solid support component is porous.

5. A particle according to claim 1 wherein the water-insoluble solid support component is a zeolite.

6. A particle according to claim 1, wherein the water-insoluble solid support component has a negative surface charge.

7. A particle according to claim 6 wherein the solid support component comprises an oxide outer surface.

8. A particle according to claim 1, wherein the liquid or liquefiable active component is a perfume.

9. A particle according to claim 1, wherein the water-soluble and/or water dispersible encapsulating material comprises a polysaccharide.

10. A particle according to claim 9, wherein the water-soluble and/or water-dispersible encapsulating material comprises a starch, and optionally a plasticiser.

11. A particle according to claim 1, wherein the surface deposition enhancing cationic polymer or oligomer comprises at least 7 cationic groups.

12. A particle according to claim 1, wherein the cationic groups comprise quaternary nitrogen groups.

13. A particle according to claim 1, wherein the surface deposition enhancing cationic polymer or oligomer has a weight average molecular weight of from 500 to below 100 000 Da.

14. A particle according to claim 1, wherein the surface deposition enhancing cationic polymer or oligomer has an average degree of cationic substitution of from above 2% to 70%.

15. A particle according to claim 1, wherein the surface deposition enhancing cationic polymer or oligomer comprises cationic groups provided by unsaturated cyclic amine groups.

16. A particle according to claim 1, wherein the zeta potential of the particle is more neutral than −30 mV, preferably more neutral than −20 mV.

17. A method of making a particle according to claim 1, the method comprising the steps of:

(i) contacting the water-insoluble solid support component with the liquid or liquefiable active component to form a first mixture; and (ii) contacting the first mixture obtained in step (i) with the surface deposition enhancing cationic polymer or oligomer to form a second mixture; and (iii) contacting the second mixture obtained in step (ii) with the water-soluble and/or water-dispersible encapsulating material to form a composition; and (iv) optionally, drying the composition of step (iii), wherein step (ii) occurs subsequent to step (i) and prior to steps (iii) and (iv).

18. A method according to claim 17, wherein step (ii) takes place at a pH of from 4 to 7.

19. A laundry detergent composition comprising a detergent auxiliary particle according to claim 1 and optionally one or more adjunct components.

* * * * *

UNITED STATES PATENT AND TRADEMARK OFFICE

CERTIFICATE OF CORRECTION

PATENT NO. : 7,470,654 B2
APPLICATION NO. : 11/220218
DATED : December 30, 2008
INVENTOR(S) : Fabrizio Meli et al.

It is certified that error appears in the above-identified patent and that said Letters Patent is hereby corrected as shown below:

Title Page
Item (54) Delete title "Anime-Based" and insert -- Amine-Based --.

Signed and Sealed this

Eighteenth Day of August, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,470,654 B2
APPLICATION NO. : 11/220218
DATED : December 30, 2008
INVENTOR(S) : Fabrizio Meli et al.

It is certified that error appears in the above-identified patent and that said Letters Patent is hereby corrected as shown below:

Title Page, Item (54) and Column 1, line 3,
Delete title "Anime-Based" and insert -- Amine-Based --.

This certificate supersedes the Certificate of Correction issued August 18, 2009.

Signed and Sealed this

Eighth Day of September, 2009

David J. Kappos

David J. Kappos
*Director of the United States Patent and Trademark Office*